US005249858A

United States Patent [19]

Nusser

[11] Patent Number: 5,249,858

[45] Date of Patent: Oct. 5, 1993

[54] MOTOR DRIVEN MOVABLE CABINET

[76] Inventor: Marjorie A. Nusser, 141 Seminary Dr., Apt. I, Mill Valley, Calif. 94941

[21] Appl. No.: 878,053

[22] Filed: May 4, 1992

[51] Int. Cl.[5] ..... A47B 88/00

[52] U.S. Cl. ..... 312/319.6; 312/248; 312/325

[58] Field of Search ..... 312/266, 305, 304, 324, 312/325, 246, 247, 245, 319.8, 319.5, 319.6; 248/284, 585

[56] References Cited

U.S. PATENT DOCUMENTS

| | | | |
|---|---|---|---|
| 2,382,354 | 8/1945 | Wales . | |
| 2,473,239 | 6/1949 | Boyd . | |
| 2,910,335 | 10/1959 | Wales . | |
| 3,729,245 | 4/1973 | Skifstrom . | |
| 3,950,050 | 4/1976 | Kinder . | |
| 4,076,351 | 2/1978 | Wyant . | |
| 4,134,629 | 1/1979 | Hansen | 312/246 |
| 4,270,723 | 7/1981 | Takahashi | 248/284 |
| 4,403,760 | 9/1983 | Alvermann | 248/284 |
| 4,915,461 | 4/1990 | Kingsborough | 312/247 |
| 5,058,846 | 10/1991 | Close | 312/247 |
| 5,076,649 | 12/1991 | Therkelsen | 312/319.5 |

FOREIGN PATENT DOCUMENTS

| | | | |
|---|---|---|---|
| 3409990 | 7/1984 | Fed. Rep. of Germany | 312/247 |

*Primary Examiner*—Peter M. Cuomo
*Assistant Examiner*—Flemming Saether
*Attorney, Agent, or Firm*—Flehr, Hohbach, Test, Albritton & Herbert

[57] ABSTRACT

A motor driven movable cabinet that provides top shelf accessibility by being lowered outwardly onto the underlying counter top and retracted back to its original position against the wall. A motor driven threaded screw lifting mechanism powers the cabinet's movement and consists of a reversible electric motor and a drive shaft assembly, including a drive shaft and a threaded screw drive rod. The motor is attached to the drive shaft assembly by a universal joint and a load bearing bracket pivot assembly. This motorized mechanism is then fastened to a wall frame that is secured to the wall behind the cabinet. The cabinet is also attached to the wall frame by at least four L-shaped swing arms and to the motorized mechanism by a pivot mount bracket hingedly attached to the bottom of the cabinet. The pivot assembly supports the drive shaft assembly and the universal joint allows for a change in the angle from the pivot assembly along the drive shaft and threaded screw drive rod to the bottom of the cabinet. The actual raising and lowering operations result when the motor rotates the drive shaft causing the rod to shorten as it screws up into the shaft thereby raising the cabinet. The cabinet is lowered when the threaded screw rod lengthens by unscrewing from the drive shaft. At least four L-shaped swing arms assist the motored mechanism in moving the cabinet by maintaining the cabinet's parallel position to the wall.

8 Claims, 6 Drawing Sheets

MOTOR DRIVEN MOVABLE CABINET

BACKGROUND OF THE INVENTION

This invention relates to mechanisms for lowering and retracting cabinets, cabinet housings, and the like, specifically to an improved electrical mechanism which directs the lateral in-out movement and guides the accompanying vertical up-down displacement of a cabinet such that the upper shelves are accessible to persons with restricted physical abilities like senior citizens and the physically challenged.

SUMMARY OF THE INVENTION

The passage of the 1988 Federal Fair Housing Law by the U.S. Congress and signed by President Reagan went into effect in 1992. The law requires new multi-family housing to accommodate the disabled. Currently a niche market today, housing for the disabled will be an expanding market tomorrow. The housing industry now has awakened to the special needs of the physically challenged and the elderly population for "barrier-free" housing and are examining ways to fulfill them with products of reasonable cost. My invention addresses these issues and provides the ideal solution.

A major housing design problem is created by the standard fixed-position wall cabinet. This cabinet construction creates the problem of inaccessible top shelves for a growing population with restricted physical abilities. Current solutions of utilizing a stepping stool, chair, or small ladder to access the top shelves are a major inconvenience and a significant safety hazard especially for senior citizens. These solutions are simply not an option for some physically challenged people such as those using a wheelchair.

Thus, the motor driven movable cabinet offers the solution by combining the ease of use provided by an automated operating system with the unique multi-directional movement of the cabinet in an out-down-up-in motion cycle. The motion cycle of the cabinet is achieved through a motor driven threaded screw lifting mechanism that utilizes L-shaped swing arms to guide and provide added support to the cabinet during the moving operation. Electronic safety features include object detection through a touch plate covering the entire base of the cabinet and automatic shut off when the cabinet reaches its designated retracted or extended positions. Operator interaction has also been minimized through a simple electrical switch plate that offers three operations (up, down, and off).

Heretofore, inventors have developed various cabinet moving mechanisms to address the issues of convenience, safety, ease of use, and efficiency. U.S. Pat. No. 4,076,351 issued to Wyant (1978) shows a spring-coil mechanism for lowering and retracting a cabinet. While the cabinet moves out and down allowing the top shelves to be accessible, the spring-coil apparatus lacks critical safety devices to prevent damage to items left in the way of the cabinet's descent. Additionally, the cabinet's operation is manually initiated which is an inconvenience for persons with physical limitations. Another safety consideration, pertinent to spring-coil mechanisms, is the lack of a provision for handling the weight stress of an uneven shelf load distribution. This stress induces a dangerous twisting action which causes the cabinet to lean forward endangering the contents of the cabinet and the user. Spring loaded mechanisms are also subject to a higher wear factor than motor driven mechanisms.

U.S. Pat. No. 3,729,245 issued to Skifstrom (1973) details a motor driven mechanism for vertically lowering and raising a cabinet. This mechanism employs a complex electronic circuitry design to operate a dual switch control panel. The extra switches on the control panel requires the full attention of the user and increases maintenance for the electrical unit. While this actuating unit incorporates a full range of safety devices, the movement of the cabinet is vertical only which limits the reach of a physically limited person whereas the movable cabinet invention incorporates lateral movement out towards the edge of the counter top which increases the person's reach by a minimum of twelve inches.

The remaining prior art utilizes various pulley designs, of which, U.S. Pat. No. 2,473,239 issued to Boyd (1949) is an excellent representation. Boyd's invention illustrates the design concept with a spring-pulley mechanism which lowers a movable shelf section from within a fixed cabinet housing. This design, while reasonable in cost, does not include safety features and the mechanism's operation is manually initiated.

OBJECTS AND ADVANTAGES

Accordingly, several objects and advantages of the motor driven movable cabinet are:

(a) to provide an automated mechanism to move a cabinet laterally and vertically allowing accessibility to the top shelves without manual assistance from the user.

(b) to provide a high level of safety through an efficient electronic circuit design that operates two limit switches to control the cabinet's range of movement and four to control the object detection function of the touch plate.

(c) to provide an electrical switch plate with three operations including a fail safe off position to minimize operator interaction with the operating controls.

(d) to provide maximum convenience and accessibility to physically challenged persons through a fully automated operation.

(e) to utilize standard cabinet dimensions, materials, and fasteners that are defined by the new housing construction industry to provide an uniform installation procedure.

(f) to provide efficient electronic circuitry to reduce wear and ensure high quality operating performance such as the smooth extension and retraction of the cabinet.

(g) to maximize work space on the counter top through an out-down-up-in operating cycle which allows small appliances and other items to remain in their customary positions on the counter top beneath the cabinet.

Still further objects and advantages will become apparent from a consideration of the unique design of this invention as described in the ensuing description and drawings.

DETAILED DESCRIPTION OF THE DRAWINGS

Figure 1:
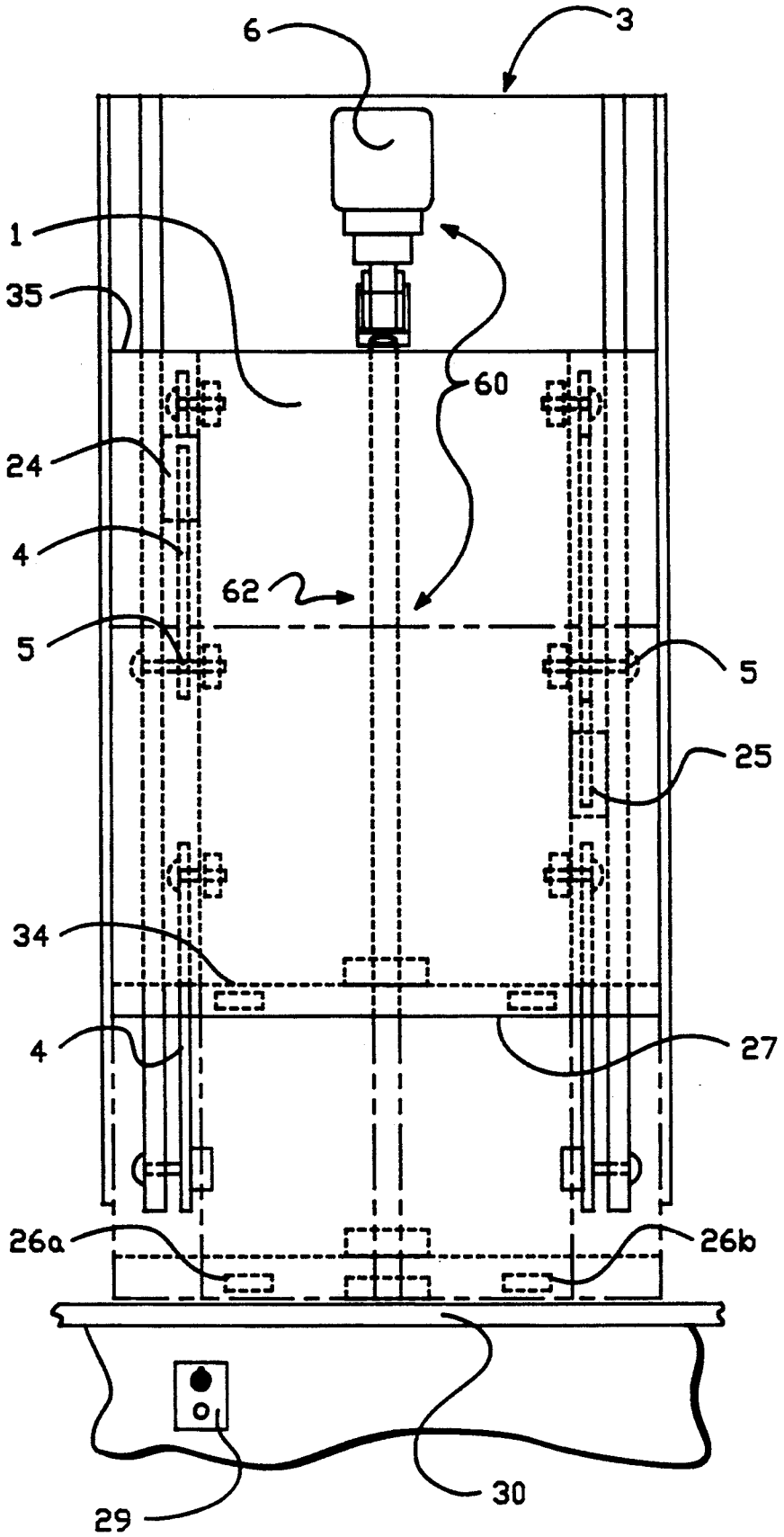
FIG. 1 shows a front view of the cabinet in its stowed position (lowered position represented by dashed lines) and the motor driven threaded screw lifting mechanism mounted on the cabinet wall frame above the cabinet.

The motor driven movable cabinet is a novel invention which will make the upper shelves of a cabinet easily accessible for many people. This invention provides a unitary, cost efficient, and convenient means for raising and lowering a cabinet. A representative embodiment of the motor driven movable cabinet is illustrated in FIG. 1 (front view) and FIG. 2 (side view).

Figure 2:
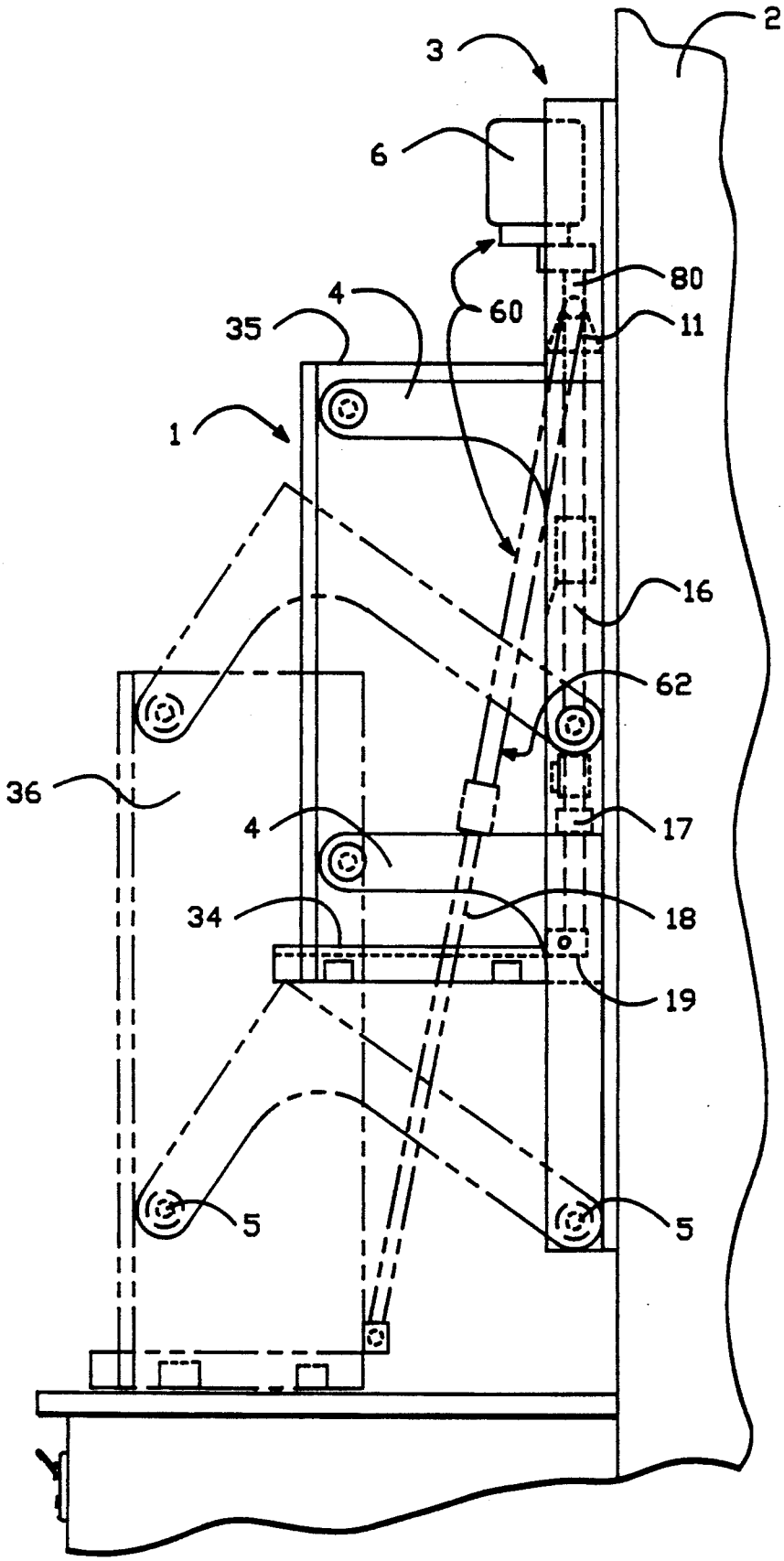
FIG. 2 shows a side view illustrating the movement of the movable cabinet from first, a retracted position against the wall to a lowered position (dotted lines) onto the counter top.
Figure 3:
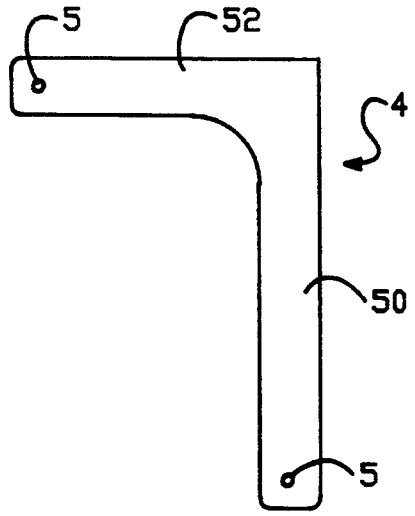
FIG. 3 is a side view of one of the four swing arms used to support and guide the operation of the cabinet.
Figure 4:
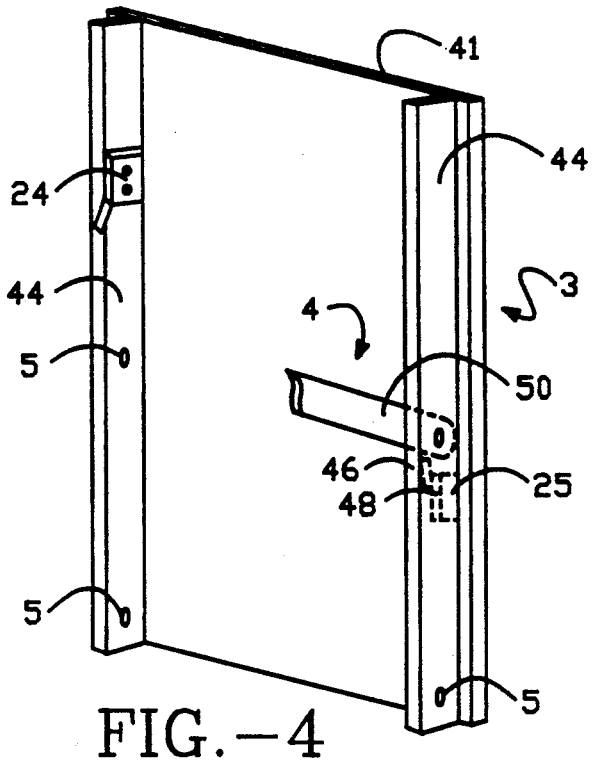
FIG. 4 displays a diagrammatic view of the cabinet wall frame that secures the cabinet and the motor driven threaded screw lifting mechanism to the wall.
Figure 5:
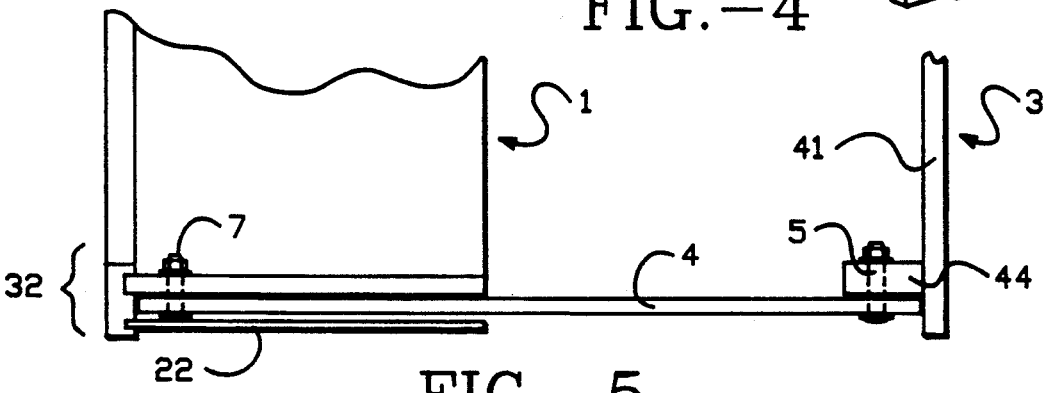
FIG. 5 is a top view of the L-shaped swing arm assembly in an extended position away from the wall.

FIG. 2 shows a cabinet wall frame 3 which is fastened to a standard wall 2 behind a cabinet 1 by a standard means that is suitable for the type of wall that the cabinet is being attached to. The cabinet wall frame 3 serves as the structural back plate to which the cabinet 1 is anchored to the wall and also as the supporting base to which a motor driven threaded screw lifting mechanism 60 will be mounted. FIG. 4 displays the vertical cabinet wall frame 3 comprising of a rectangular back frame 41 with two vertically mounted side rails 44 located on opposite sides of the frame 41. The longer side of the rectangular cabinet wall frame 3 is positioned vertically in relation to the ceiling and the floor and fastened to the wall by standard means. After the cabinet wall frame 3 is in place, at least four L-shaped swing arms 4 (FIG. 3) are then pivotally attached to the frame 3. FIG. 5 illustrates the attachment of a swing arm 4 by inserting a standard fastener 7 such as a bolt or other equivalent means fastening into the hinge point 5 located on the vertical side rail 44 that is attached perpendicularly to the rectangular back frame 41 of frame 3.

Referencing FIG. 2, the swing arms 4 (two pictured) ensure the upright parallel position of the cabinet 1 and allow for a sturdy non-binding movement of the cabinet 1 when it is being raised and lowered. The swing arm design is unique because it provides both a downward and outward movement of the cabinet 1 while providing for the hinge points 5 to both, the cabinet 1 and the cabinet wall frame 3, to be parallel at all times. Using the swing arm pictured in FIG. 6, the hinge points 5 are where the swing arm 4 is pivotally attached to the cabinet wall frame 3 and the cabinet 1. The advantage of having all four hinge points parallel between the cabinet and the cabinet wall frame is that the binding of the cabinet is prevented and therefore, the potential for the cabinet to twist is eliminated. Referring back to FIG. 2, the 90 degree angle of the swing arms permits the use of a reversible electric motor 6 to move the cabinet 1 down (dotted lines) when rotating forward and up when rotating backwards. The four swing arms 4 (two pictured) will be sized accordingly to and constructed of a material suitable to support the selected cabinet size.

Figure 6:
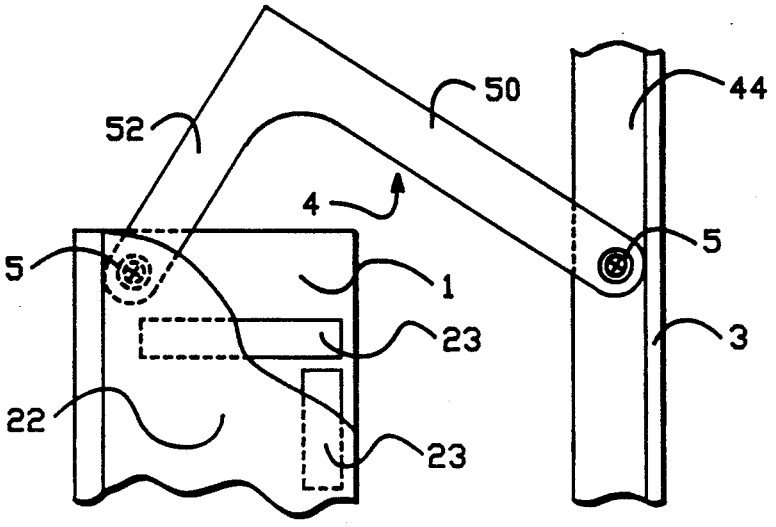
FIG. 6 presents a side view of the L-shaped swing arm assembly in an extended position away from the wall.

In this preferred embodiment of the invention, the swing arms have a 90 degree L-shape with one end longer than the other. Other swing arms with different sizes and shapes could be substituted without substantially altering the operation of the invention. However, the L-shape is more aesthetic than the other shapes and allows the swing arm 4 to be easily concealed under the cabinet side cover 22 as illustrated in FIG. 6. Also, the L-shape arm provides an automatic stop against the cabinet wall frame 3 when the arm is in a retracted position as observed in FIG. 2. Referencing FIG. 3, the invention requires at least four swing arms 4 of equal length, each having a first end 50 and a second end 52. The arms need to be of equal length because more stress is placed on the motor during the lifting operation if the arms are too short or too long. Only one of the swing arms has a swing arm lever 46 as pictured in FIG. 4 to be used for a function introduced later. In FIG. 6, an upper swing arm 4 is shown pivotally attached to the cabinet wall frame 3 and to the cabinet 1. The first end 50, which is the longer side of the swing arm, is pivotally attached to the upper hinge point 5 of the vertical side rail 44 of the cabinet wall frame 3. The remaining swing arms are attached in a similar fashion and are pictured in FIG. 1.

The four swing arm assemblies 32 (one pictured in FIG. 5), together with the cabinet wall frame 3, provide the base to which the cabinet 1 is pivotally attached. The cabinet 1 pictured in FIG. 2 is an enclosure that has a top wall 35, a bottom wall 34, and two vertical side walls 36 and is made of standard materials by standard construction. Referring to FIG. 6, to attach the upper swing arm to the cabinet 1, the second end 52, which is the shorter end of the L-shaped swing arm, is pivotally attached to the forwardmost top corner of the vertical side wall 36 of the cabinet 1. The vertical side rails 44 of the cabinet wall frame 3 pivotally supports the second end 52 of at least four swing arms 4 connected to the cabinet 1. As shown in FIG. 2, the four swing arms 4 must be positioned such that there are two on each side of the side walls 36, with one near the top wall 35 and the other near the bottom wall 34 of the cabinet 1. The appropriate spacing between the relative top and bottom positions of the swing arms will depend on the height of the cabinet and the clearance from the cabinet to the underlying counter top 30. The swing arms 4 need to be fastened in the manner described or else the exact parallel position of the hinge points between the cabinet and the cabinet wall frame will not be maintained.

The rectangular shaped side cover spacers 23 shown in FIG. 6 secure the side covers 22 to the side of the cabinet 1. Next to each swing arm 4, there are two spacers 23. The first is secured horizontally near the top of the side wall 36 of the cabinet 1. The second spacer is positioned vertically and aligned to the end of the first one that extends downward along the back of the cabinet creating a 90 degree angle with no ends touching.

The cabinet side cover 22 displayed in FIG. 6 offers safety and aesthetic features. The safety feature is to prevent objects and the like from coming into contact with the moving swing arms. The aesthetics is achieved through the concealment of the swing arm assembly when the cabinet is in a retracted position against the wall (not pictured). FIG. 5 provides a top view perspective of an entire swing arm assembly 32 which shows the space between the cabinet 1 and the cover 22 into which the arm assembly 32 retracts.

FIG. 1 shows a front view of the entire power system of the cabinet which is a motor driven threaded screw lifting mechanism 60 consisting of a reversible electric motor 6 and a drive shaft assembly 62. This unique drive mechanism is used to electrically raise, lower, and retract the cabinet 1 as shown in a fully extended position in FIG. 2. A reversible 120 Volt AC electric motor 6 with reduction gearing was chosen as the source of mechanical power in this embodiment as it possesses major advantages of safety and reliability over alternate spring-loaded and human power sources. The actual motor size will be sized accordingly for the particular application, cabinet and shelf size, content weight, etc. The cylindrical motor 6 having a vertical drive shaft assembly facing downward is vertically attached to the cabinet wall frame 3 above the top wall 35 of the cabinet 1. Specifically FIG. 8 shows the back support 70 which is welded to the rear of the reversible electric motor 6 and is fastened in a centralized position on the cabinet wall frame 1 by standard fasteners 7 such as steel bolts.

Figure 7:
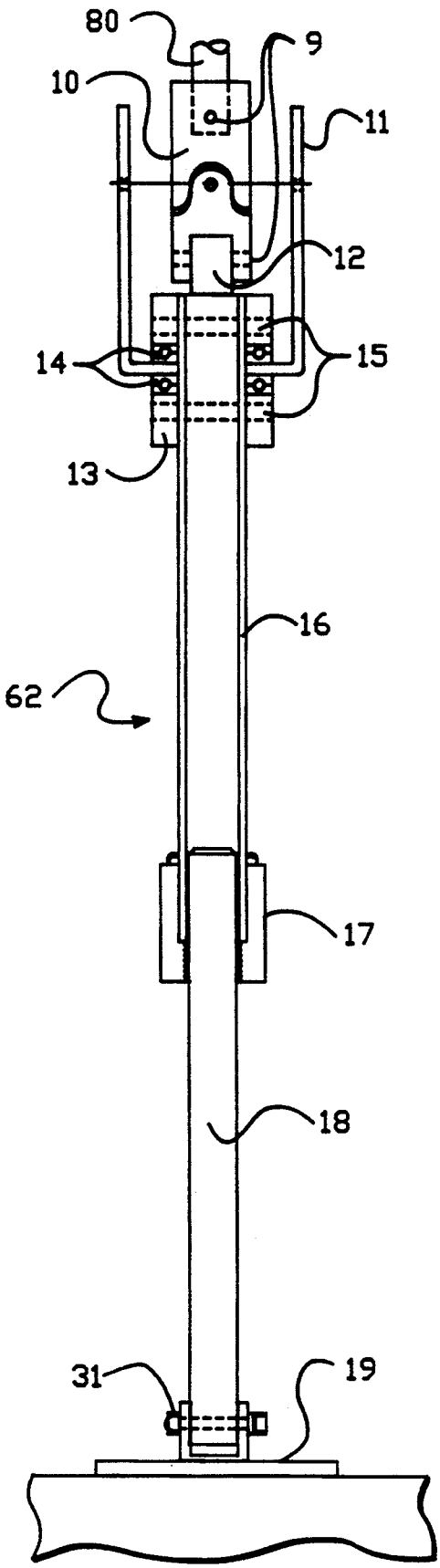
FIG. 7 is a detailed view of the drive linkage components showing how the cabinet will be raised and lowered by means of a threaded screw drive rod.
Figure 8:
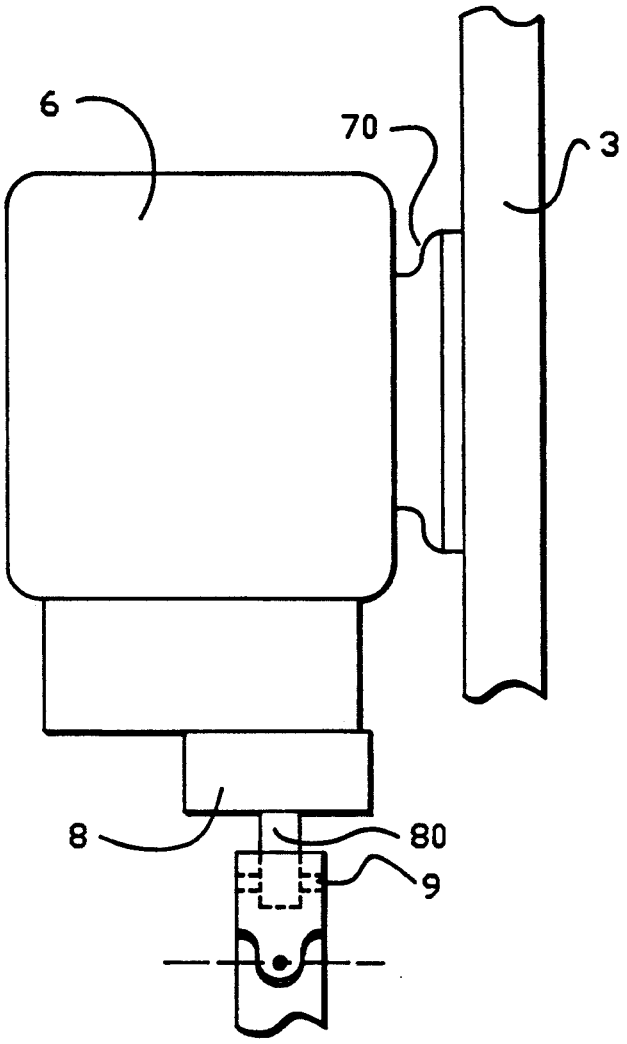
FIG. 8 is a closer side view of the reversible electric motor which will provide the mechanical power for moving the cabinet.
Figure 9:
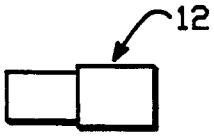
FIG. 9 shows the drive adapter independent from the rest of the drive linkages.
Figure 13:
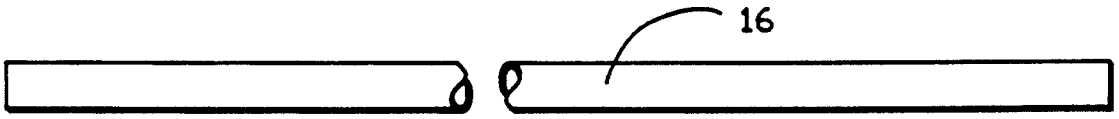
FIG. 13 shows the steel (or other metal) tubing drive shaft which transmits the rotary torque from the reversible electric motor to the drive nut.

The drive shaft assembly 62 and the reversible electric motor 6 are presented in FIGS. 7 and 8 respectively. The motor 6 includes a slip clutch 8 which drives a motor shaft 80 which in turn drives the universal joint 10. The top end of the universal joint 10 is fastened to the shaft of the slip clutch by a brass shear pin 9. The other end of the universal joint 10 is attached to the drive adapter 12 by a brass shear pin 9. The drive adapter 12 (FIG. 9) is a rounded metal rod with a diameter that permits the adapter to be welded into the steel tube drive shaft 16 (FIG. 13). The entire universal joint assembly is shown in FIG. 7. The motor is thereby attached to one end of the universal joint which is attached to the steel tube drive shaft. The power is provided by the motor but the actual weight of the cabinet is lifted by the rotation of the drive shaft and the threaded screw drive rod 18 described in more detail later.

Figure 11:
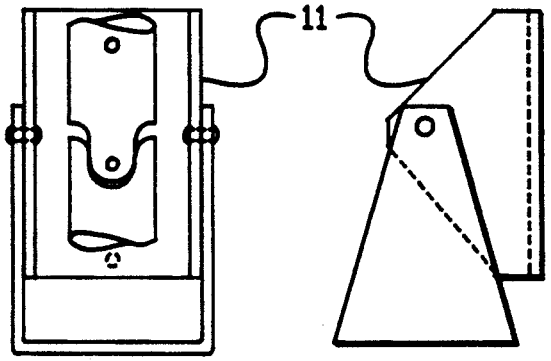
FIG. 11 illustrates a front and side perspective of the pivot assembly which will be the load bearing bracket to which the cabinet will be attached.

In FIG. 2, the load bearing bracket pivot assembly 11 (FIG. 11) is shown secured to the cabinet wall frame 3 beneath the motor 6. This pivot assembly 11 supports the steel tube drive shaft 16 through two thrust bearings 14 that are held in place by two steel stop collars 13. The collars are secured to the drive shaft 16 by two roll pins 15. The universal joint 10 allows the drive shaft 16 and the threaded screw drive rod 18, which is screwably attached to the shaft 16, to change attitude as the cabinet moves. The pivot assembly together with the thrust bearings and stop collars is used to bear the weight of the cabinet.

Figure 10:
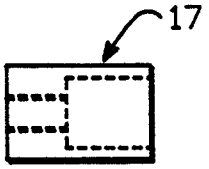
FIG. 10 illustrates the threaded and unthreaded portions of the drive nut.
Figure 12:
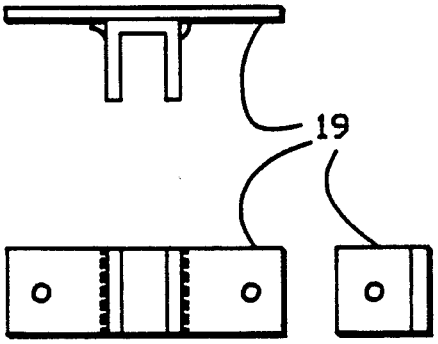
FIG. 12 exhibits an enlarged end, top and side view of the pivot mount bracket which is used to connect the threaded screw drive rod to the bottom of the cabinet.
Figure 14:
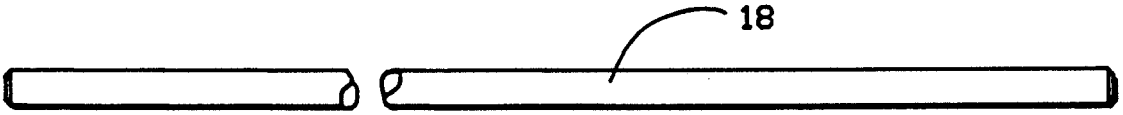
FIG. 14 displays the threaded screw drive rod.

FIG. 10 shows a drive nut 17 that has a threaded and an unthreaded end. In FIG. 7 the unthreaded end is welded to the end of the steel tube drive shaft 16 that is protruding downward away from the motor. The supported drive shaft 16 is the means by which the rotary torque from the motor is transmitted to the drive nut 17. The threaded end of the drive nut 17 is then screwed over the threaded screw drive rod 18 (FIG. 14) thus connecting the rod 18 to the shaft 16. The threaded portion of the nut 17 connects with the threads of the drive rod 18 drawing the drive rod up into the rotating drive shaft 16. The nut 17 and the rod 18 have to be properly threaded so that they can cooperatively engage during the rotation of the shaft 16. As shown in FIG. 7, the other end of the drive rod 18 is hingedly fastened to the pivot mount bracket 19 (FIG. 12) with a machine screw and lock nut 31. FIG. 2 shows the position of the pivot mount bracket 19 as the connecting point by which the drive rod 18 is hingedly attached to the bottom wall 34 of the cabinet 1. The raising and lowering operation of the cabinet is accomplished depending upon the direction of the rotation of the motor. It is the motor's rotation that rotates the drive shaft 16 to turn the drive nut 17 on the drive rod 18 so that the entire drive shaft assembly 62 connecting the cabinet 1 to the cabinet wall frame 3 shortens or lengthens. The pitch of the threads on the threaded screw drive rod, together with the speed of the motor, determines the amount of time that the cabinet will take to travel from a stowed, retracted position to a fully extended position.

Illustrated in FIG. 4 are the upward and downward travel limit switches (24 and 25 respectively) that are located on the vertical side rails 44 of the rectangular back frame 41. These two limit switches stop the ascent or descent of the cabinet 1 within its designated range of movement. The downward switch 25 is fastened beneath the upper swing arm 4 at its base with its larger flatter side placed against the inside of rail 44. The upward switch 24 is positioned similarly on the opposite side rail where the top wall of the cabinet (not pictured) will stop in its fully retracted position. This switch makes contact with the top wall of the cabinet upon it's return to a stowed position. The second end 50 of a partial swing arm is shown with a fingerlike lever 46 protruding downward that will strike the signal lever 48 on the downward switch 25 as the cabinet reaches the counter top. This swing arm is the only one that requires a lever 46. The limit switches provide the invention with an added safety feature of object detection with automatic power off capability. The limit switches themselves are square shaped switch boxes and have a protruding signal lever 48. This lever 48 is positioned vertically downward on switch 24 and vertically upward on switch 25. When the respective limit switches are activated all motorized operation is stopped as well as the cabinet.

Figure 17:
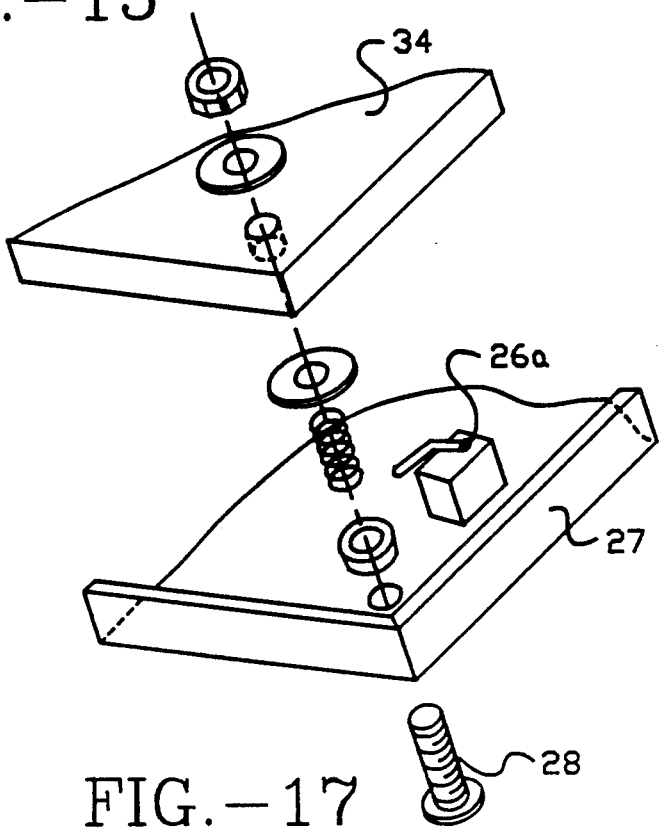
FIG. 17 shows an exploded view of one bottom corner of the touch plate with a limit switch and a spring-/bolt assembly that attaches it to the bottom wall of the cabinet.

FIG. 1 shows a touch plate 27 which covers the entire bottom wall 34 of the cabinet. The touch plate is comprised of a rectangular plate consisting of a light, durable material. This material will have the flexibility to yield to the pressure of the counter top or objects thereon which activates the four touch plate limit switches (26*a–b* pictured). As shown in FIG. 17, the touch plate 27 is suspended from the bottom wall 34 of the cabinet 1 on four spring/bolt assemblies 28 (only one shown). At each corner, specifically between the touch plate 27 and the bottom wall 34 of the cabinet, is mounted a limit switch 26*a–d* only 26*a* is shown. The pressure of the cabinet or objects located on the counter top transfers a slight tension to the spring located between the two bolts. A space of not more than ½ inch is required between the cabinet's bottom wall 34 and the touch plate 27 to properly activate the switches. By compressing the spring, the limit switch makes contact with the bottom wall 34 of the cabinet and stops the motorized operation. The remaining three spring/bolt assemblies not pictured here operate in the same fashion. FIG. 2 shows two of the touch plate limit switch positions 26*a–b*.

Figure 15:
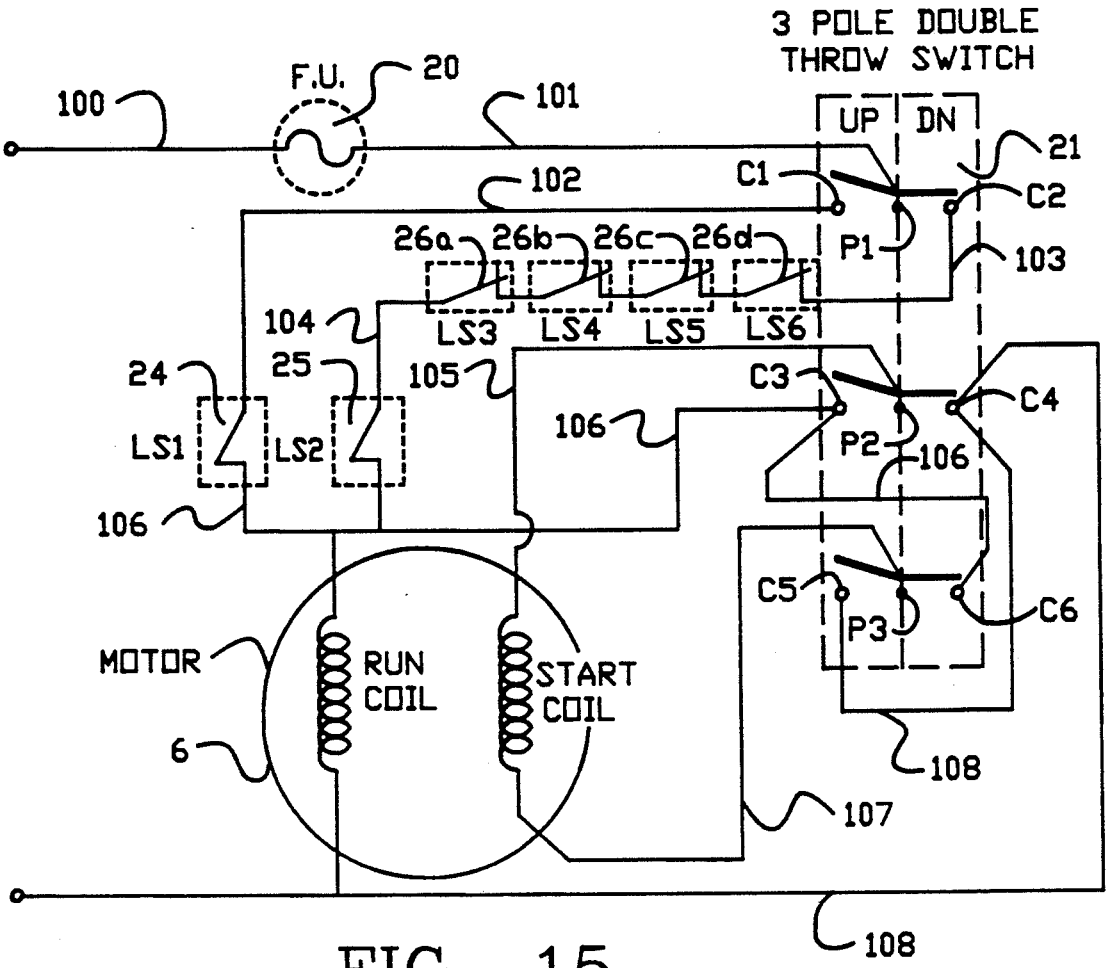
FIG. 15 is an electrical circuit schematic diagram of the control wiring for the invention including a 3 pole double throw switch, six limit switches, a fuse, and an electric motor.
Figure 16:
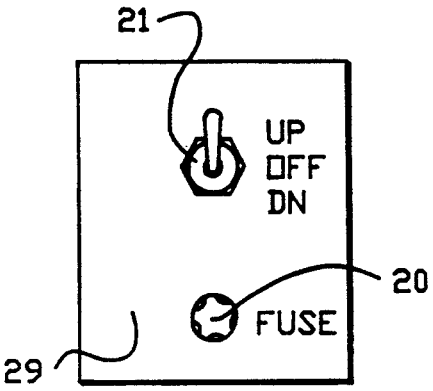
FIG. 16 shows the escution and mounting arrangement of the electrical switch plate.

The electrical circuit is shown in FIG. 15 and is comprised of a reversible electric motor 6, six limit switches LS1, LS2, LS3, LS4, LS5, LS6, 24, 25, 26*a–d*, a three pole double throw switch 21, and a fuse 20 (FU). Normal 115 volt AC power is connected with the live wire 100 on the one side of fuse 20. The neutral wire 108 is connected to the bottom side of the run coil of motor 6 and to contact C4 on the second pole P2 of the switch 21. The live side voltage is connected from the fuse by wire 101 to the center of pole 1 P1 of the switch 21. The voltage can be fed to either contact C1 or C2 depending on the position of the switch 21. (FIG. 15 shows the contacts when the cabinet is in the lowered position). FIG. 16 shows the arrangement of the electrical switch plate 29 with the location of the fuse 20 and switch 21. The plate 29 is mounted on the front of the lower set of cabinets as shown in FIG. 1 but could also be located on the wall or the upper cabinet itself.

The electrical design for the remaining wiring connections is presented next. Wire 102 is connected from contact C1 of pole P1 to the upward travel limit switch LS1 24. Wire 106 connects the lower sides of limit switches 24 and 25 to contact C3 of pole P2 and to the upper side of the run coil of motor 6. Wire 103 connects contact C2 of pole P1 to the four touch plate limit switches 26*a–d* (LS3–LS6). Wire 104 connects the other side of the limit switches 26*a–d* to the downward travel limit switch 25 LS2. The top of the start coil of motor 6 is connected to the center of the second pole P2. There is a jumper 106 between C3 and C6 and jumper 108 between C4 and C5. The pole P3 is connected to the bottom of the start coil of the motor 6.

From the preceding description, the advantages of my motor driven movable cabinet are:

a) The unique combination of lateral in-out and vertical up-down movements that increases the reach and therefore, accessibility to the top shelves of a cabinet by persons who are physically challenged, have physical limitations, or are of a shorter statue.

b) The combination of the unique motion cycle of the cabinet with the fully automated operating system provides maximum convenience to the user.

c) The inclusion of the safety touch plate on the bottom of the cabinet, an easy three position switch control panel, and reversible motor with slip stops all combine to offer safety against the forward tipping of the cabinet, operator error, slippage of the cabinet during a power failure, and damage to items left in the cabinet's path of descent or injury to the user.

d) The electronic circuitry offers a simple, cost effective, robust design that will reduce maintenance costs and the chance of electronic failure.

e) Incorporation of standard measurements for the dimensions of the cabinet allows the motorized component of the cabinet to conform to standardized ceilings and to standard cabinet clearances of the counter top. The invention is versatile and can be sized to accommodate different cabinet dimensions.

OPERATION OF THE INVENTION

The unique motorized out-down operation of the motor driven movable cabinet provides a novel method for enabling physically limited people to fully utilize a standard amenity in buildings: the wall mounted cabinet. Therefore, the operation of the invention can be identified as the lowering of a wall cabinet to the outer edge of the underlying counter top by utilizing an out-down movement and then being able to retract the cabinet to its original position against the wall. The appealing aspect here is that the work space on the counter top is maximized by allowing small appliances or other items to remain in their customary positions on the counter top against the wall. Safety features have also been incorporated into the motorized cabinet's design that allow the cabinet to be stopped by either the operator or by objects activating the touch plate that covers the base of the cabinet.

The motorized movable cabinet design operates on a parallelogram system where the L-shaped swing arms function to keep the cabinet parallel to the wall at all times during the operating cycle. The swing arms are key in preventing the cabinet from tipping forward once it begins to move. The motor driven screw lifting mechanism provides the force necessary to move the cabinet and keeps the center of gravity at the base of the cabinet. The cabinet is driven by an reversible electrical motor and drive shaft assembly which raises and lowers the cabinet. The rotation of the motor rotates the steel tube drive shaft that turns the drive nut that is screwably attached to the drive rod. Then depending upon the direction of the rotation the threaded screw drive rod shortens or lengthens and correspondingly raises or lowers the cabinet. The universal joint is the component that allows the drive shaft assembly to change its attitude while the cabinet is moving. This change in attitude means that the cabinet can move outwardly in an upright position with the drive shaft assembly at an angle to the wall. Since the motor generates significant torque (force), a slip clutch was included to limit the force transmitted from the motor when a limit switch is activated or when a power failure occurs. The clutch holds the drive linkage stationary thereby allowing the cabinet to remain in place until power is restored.

The load bearing bracket pivot assembly supports the drive shaft and provides a fixed point behind the cabinet from which the cabinet's weight is secured. At the point of the pivot assembly, the thrust bearings transfer the load from the pivot assembly to the drive shaft while allowing for a change in the angle from the pivot assembly along the drive shaft and threaded screw drive rod to the back of the cabinet. The ability of the drive assembly to change its angle and carry the cabinet out away from the wall is very important in increasing the accessibility to the top shelves.

The electrical circuit design along with the touch plate and limit switches provides for the safe operation of the movable cabinet. The loosely fitted touch plate conceals the limit switches that will stop the movement of the cabinet if something is encountered in its path. Additional upper and lower limit switches prevent the cabinet from exceeding the desired range of movement. The three position switch allows for easy operation and provides direct control over the movement of the cabinet which can be stopped at any point and have its direction reversed. The time to complete a full operational cycle (out-down-up-in) will vary according to the weight and size specifications of the cabinet as well as the size of the motor and the pitch of the threads of the threaded screw drive rod.

Although the description above contains many specifications, these should not be construed as limiting the scope of the invention but as merely providing an illustration of the presently preferred embodiment of this invention. Thus the scope of this invention should be considered in its broadest aspects and determined by the appended claims and their legal equivalents, rather than the examples provided.

The preceding detailed description of the invention provides the basis of the claims.

I claim:

1. A motor driven movable cabinet capable of being lowered over a counter space in its extended position and lifted against a wall in its retracted position, comprising:

a cabinet enclosure having a top wall, a bottom wall, and two vertical side walls connected thereto;

at least four swing arms of equal length, each having a first end and a second end, wherein said first end of at least two of said swing arms is pivotally attached to each of said vertical side walls;

a vertical cabinet wall frame including two vertical side rails for pivotally supporting said second ends of said at least four swing arms connected to the cabinet enclosure;

a vertical motor affixed to said wall frame above said cabinet enclosure, having a vertical motor shaft facing downward;

a variable length drive shaft assembly comprising a tube drive shaft and a threaded screw drive rod screwably connected thereto; wherein said tube drive shaft is connected to said vertical motor by means of a universal joint, and wherein, said threaded screw drive rod is hingedly attached to said bottom wall of the cabinet enclosure;

whereby the rotation of said motor causes the arcuate lifting of the cabinet enclosure and drive shaft assembly in one direction by shortening said variable length drive shaft assembly and the arcuate lowering of the cabinet enclosure and drive shaft assembly in the opposite direction by lengthening said variable length drive shaft assembly.

2. The cabinet described in claim 1, further comprising a limit switch assembly to automatically stop the lifting and lowering of said cabinet enclosure, said limit switch assembly having a first lever mounted on one of said swing arms and a second lever mounted on said vertical cabinet wall frame, wherein said switch assembly stops the rotation of said motor when said first lever contacts said second lever.

3. The cabinet described in claim 1, further comprising a load bearing bracket pivot assembly secured to said wall frame to support said drive shaft assembly.

4. The cabinet described in claim 1, wherein each of said at least four swing arms consists of an L-shaped structure.

5. A motor driven movable cabinet capable of being lowered over a counter space in its extended position and lifted against a wall in its retracted position, comprising:

a shelf means for storing objects;

a guide means coupled to said wall and said shelf means to direct movement of said shelf means in an arcuate path;

a vertical motor affixed to said wall having a vertical motor shaft;

a variable length drive shaft assembly having a first shaft end and a second shaft end, said first shaft end being pivotally connected to said vertical motor shaft to allow said shelf means to move in an arcuate path while allowing rotation of the shaft assembly, and said second shaft end being hingedly attached to said shelf means;

wherein the rotation of said motor causes the lifting of the cabinet enclosure in one direction by shortening said variable length drive shaft assembly and the lowering of the cabinet enclosure in the opposite direction by lengthening said variable length drive shaft assembly.

6. The shelf described in claim 5, further comprising a load bearing bracket pivot assembly secured to said wall to support said variable length drive shaft assembly.

7. The shelf described in claim 5, wherein said guide means comprise swing arms of equal length, each having a first arm end and a second arm end, said first arm end of at least two of the swing arms being pivotally coupled to said shelf means and said second arm end of said at least two of the swing arms being pivotally coupled to said wall.

8. The shelf described in claim 7, wherein each of said at least two swing arms consists of an L-shaped structure.

* * * * *